US012173938B2

(12) United States Patent
Kim

(10) Patent No.: US 12,173,938 B2
(45) Date of Patent: Dec. 24, 2024

(54) CONDENSER MODULE AND THERMAL MANAGEMENT SYSTEM INCLUDING THE SAME

(71) Applicants: Hyundai Motor Company, Seoul (KR); Kia Corporation, Seoul (KR)

(72) Inventor: Ki Mok Kim, Busan (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 192 days.

(21) Appl. No.: 17/821,592

(22) Filed: Aug. 23, 2022

(65) Prior Publication Data

US 2023/0184470 A1 Jun. 15, 2023

(30) Foreign Application Priority Data

Dec. 15, 2021 (KR) ..... 10-2021-0179806

(51) Int. Cl.
*F25B 41/20* (2021.01)
*F25B 39/04* (2006.01)

(52) U.S. Cl.
CPC ..... *F25B 41/20* (2021.01); *F25B 39/04* (2013.01); *F25B 2400/04* (2013.01)

(58) Field of Classification Search
CPC ..... F25B 41/20; F25B 39/04; F25B 2400/04
See application file for complete search history.

(56) References Cited

U.S. PATENT DOCUMENTS

2014/0305154 A1* 10/2014 Yoshioka ..... F16K 11/087 137/625

FOREIGN PATENT DOCUMENTS

CN 202470529 U * 10/2012
KR 20190124032 A 11/2019
KR 20200038608 A * 4/2020

OTHER PUBLICATIONS

Shaoming, Heat Pump System, Oct. 3, 2012, CN202470529U, Whole Document (Year: 2012).*
Lee et al., Thermal Management System, Apr. 14, 2020, KR20200038608A, Whole Document (Year: 2020).*

* cited by examiner

*Primary Examiner* — Larry L Furdge
(74) *Attorney, Agent, or Firm* — MCDONNELL BOEHNEN HULBERT & BERGHOFF LLP

(57) ABSTRACT

Disclosed are a condenser module and a thermal management system including the same. The condenser module includes a heat exchange device including a first inlet/outlet and a second inlet/outlet having a refrigerant flowing therein into or discharged therefrom and a flow path formed therein through which the refrigerant flows between the first inlet/outlet and the second inlet/outlet, and a flow-path switching valve connected to each of the first inlet/outlet and the second inlet/outlet, the flow-path switching valve switchable between a first operation mode, in which the refrigerant flows into the first inlet/outlet and the refrigerant is discharged from the second inlet/outlet, and a second operation mode, in which the refrigerant flows into the second inlet/outlet and the refrigerant is discharged from the first inlet/outlet. The flow path formed in the heat exchange device has different positions in a direction of gravity between the first inlet/outlet and the second inlet/outlet.

10 Claims, 11 Drawing Sheets

CONDENSER MODULE AND THERMAL MANAGEMENT SYSTEM INCLUDING THE SAME

CROSS-REFERENCE TO RELATED APPLICATIONS

This application claims priority from Korean Patent Application No. 10-2021-0179806, filed on Dec. 15, 2021, in the Korean Intellectual Property Office, the disclosure of which is incorporated herein by reference in its entirety.

TECHNICAL FIELD

The present disclosure relates to a condenser module capable of switching a flow path during cooling and heating, and a thermal management system including the same.

BACKGROUND

Recently, the number of eco-friendly vehicles registered in Korea has increased due to policies encouraging the proliferation of eco-friendly vehicles and the preference for high-efficiency vehicles. An electric vehicle, which is a type of eco-friendly vehicle, is a vehicle operated using an electric battery and an electric motor without using petroleum fuel or an engine. Since the electric vehicle has a system that drives the vehicle by rotating the motor using electricity stored in the battery, the electric vehicle does not emit harmful substances, and is quiet and highly efficient.

In the case of a vehicle using engine power of the related art, an in-vehicle heating system is operated using waste heat of an engine. However, since an electric vehicle does not have an engine, the electric vehicle has a system that uses electricity to operate a heater. Accordingly, the electric vehicle has a problem in that the mileage is significantly reduced while the heater is running.

In addition, the battery module should be used in an optimal temperature environment in order to maintain optimal performance and long life thereof. However, it is difficult to use the battery module in such an optimal temperature environment due to heat generated during driving and external temperature changes. In order to solve the above-described problems, a method of combining an air-conditioning system of the electric vehicle and a thermal management system thereof is being actively discussed.

A refrigerant cycle applied to the air-conditioning system of the vehicle includes an external condenser disposed outside the vehicle. Here, the external condenser is used as a radiator in an indoor cooling mode and is used as an evaporator in an indoor heating mode. When the external condenser is used as a radiator, cooling performance is improved when a refrigerant flows from an upper portion of the external condenser to a lower portion thereof. Further, when the external condenser is used as an evaporator, heat absorption performance is improved when the refrigerant flows from the lower portion to the upper portion.

However, the external condenser of the related art includes a fixed flow path so that the refrigerant flows from the upper portion to the lower portion or from the lower portion to the upper portion. Particularly, the external condenser of the related art has a problem in that the heat absorption performance deteriorates during indoor heating due to the configuration in which a flow path is formed so that the refrigerant flows from the upper portion to the lower portion in order to secure cooling performance.

The information disclosed in this Background of the disclosure section is only for enhancement of understanding of the general background of the disclosure, and should not be taken as an acknowledgement or any form of suggestion that this information forms the related art already known to a person skilled in the art.

SUMMARY

Therefore, the present disclosure has been made in view of the above problems, and it is an object of the present disclosure to provide a condenser module capable of switching the flow direction of a refrigerant flowing into an external condenser, and a thermal management system including the same.

In accordance with an aspect of the present disclosure, the above and other objects can be accomplished by the provision of a condenser module including a heat exchange device including a first inlet/outlet and a second inlet/outlet having a refrigerant flowing thereinto or discharged therefrom, the heat exchange device including a flow path formed therein through which the refrigerant flows between the first inlet/outlet and the second inlet/outlet, and a flow-path switching valve connected to each of the first inlet/outlet and the second inlet/outlet, the flow-path switching valve switchable between a first operation mode, in which the refrigerant flows into the first inlet/outlet and the refrigerant is discharged from the second inlet/outlet, and a second operation mode, in which the refrigerant flows into the second inlet/outlet and the refrigerant is discharged from the first inlet/outlet. The flow path formed in the heat exchange device may have different positions in a direction of gravity between the first inlet/outlet and the second inlet/outlet.

The flow path entering at the first inlet/outlet of the heat exchange device and exiting at the second inlet/outlet thereof may extend upwards in the direction of gravity, and the flow path entering at the second inlet/outlet thereof and exiting at the first inlet/outlet thereof may extend downwards in the direction of gravity.

The flow-path switching valve may be connected to each of an inlet line and an outlet line, the flow-path switching valve connecting the inlet line to the first inlet/outlet and connecting the outlet line to the second inlet/outlet in the first operation mode and connecting the inlet line to the second inlet/outlet and connecting the outlet line to the first inlet/outlet in the second operation mode.

The flow-path switching valve may be a 4-way valve including two inlets and two outlets so that the inlet line is connected to one of the first inlet/outlet and the second inlet/outlet and the outlet line is connected to the other one of the first inlet/outlet and the second inlet/outlet.

The condenser module may further include a bypass valve disposed at a point upstream of the flow-path switching valve in a flow direction of the refrigerant, and configured to cause the refrigerant flowing thereinto to flow to the flow-path switching valve or to be switched to cause the refrigerant flowing thereinto to bypass the flow-path switching valve and the heat exchange device.

In accordance with another aspect of the present disclosure, there is provided a thermal management system including the condenser module of the present disclosure, the thermal management system including a compressor located at a point upstream of the condenser module in a flow direction of the refrigerant and configured to compress and discharge the refrigerant flowing thereinto at high temperature and high pressure, an evaporator located at a point downstream of the condenser module in the flow direction of the refrigerant and configured to evaporate the flowing refrigerant, a first expansion valve located at a point upstream of the condenser module in the flow direction of the refrigerant and configured to permit flow of, block, or expand the refrigerant flowing into the condenser module, a second expansion valve located at a point upstream of the evaporator in the flow direction of the refrigerant and configured to permit flow of, block, or expand the refrigerant flowing into the evaporator, and a refrigerant circulation flow path extending so that the refrigerant flowing thereinto circulates while sequentially passing through the compressor, the first expansion valve, the condenser module, the second expansion valve, and the evaporator.

The thermal management system may further include an indoor condenser located between the compressor and the condenser module in the flow direction of the refrigerant and configured to disperse the refrigerant discharged from the compressor therearound.

The thermal management system may further include a controller, configured to control, in an indoor heating mode, the first expansion valve to expand the refrigerant flowing thereinto and to control the flow-path switching valve so that the refrigerant expanded in the first expansion valve flows into the first inlet/outlet of the heat exchange device and is discharged from the second inlet/outlet thereof. The flow path entering at the first inlet/outlet of the heat exchange device and exiting at the second inlet/outlet thereof may extend upwards in the direction of gravity.

The thermal management system may further include a chiller configured to branch from a point downstream of the condenser module in the flow direction of the refrigerant, located to be connected to the compressor in parallel with the evaporator, and configured to heat-exchange the refrigerant discharged from the condenser module with a coolant, and a third expansion valve located at a point upstream of the chiller in the flow direction of the refrigerant and configured to permit flow of, block, or expand the refrigerant flowing into the chiller.

The thermal management system may further include a controller configured to control, in an indoor cooling mode, the flow-path switching valve so that the refrigerant flowing into the flow-path switching valve flows into the second inlet/outlet of the heat exchange device and is discharged from the first inlet/outlet thereof, and to control the second expansion valve or the third expansion valve to expand the refrigerant flowing thereinto. The flow path entering at the second inlet/outlet of the heat exchange device and exiting at the first inlet/outlet thereof may extend downwards in the direction of gravity.

The thermal management system may further include a bypass valve, disposed at a point upstream of the flow-path switching valve in the flow direction of the refrigerant, and configured to cause the refrigerant flowing thereinto to flow to the flow-path switching valve or to be switched to cause the refrigerant flowing thereinto to flow to the evaporator by bypassing the flow-path switching valve and the heat exchange device.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
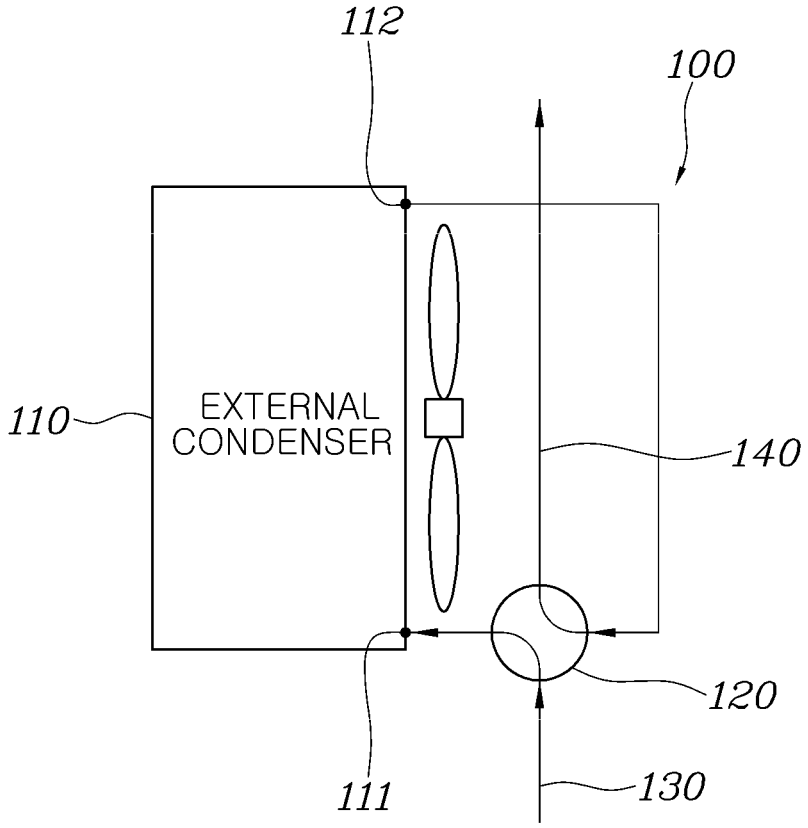
FIG. 1 shows a block diagram of a condenser module in a first operation mode according to an embodiment of the present disclosure.

Specific structural or functional descriptions in the embodiments of the present disclosure disclosed in this specification or application are merely illustrative for the purpose of describing embodiments according to the present disclosure. Further, the present disclosure may be implemented in various forms and should not be construed as being limited to the embodiments described in this specification or application.

Since the embodiments according to the present disclosure may have various modifications and may have various forms, specific embodiments are illustrated in the drawings and described in detail in this specification or application. However, it should be understood that the embodiments according to the concept of the present disclosure are not intended to be limited to specific disclosed forms, and include all modifications, equivalents, and substitutes included in the spirit and technical scope of the present disclosure.

Meanwhile, in the present disclosure, terms such as first and/or second may be used to describe various components, but the components are not limited by the terms. The terms are used only for the purpose of distinguishing one component from other components. For example, a first component may be referred as a second component, and similarly, a second component may also be referred to as a first component without departing from the scope of rights according to the concept of the present disclosure.

When one component is referred to as being "connected" or "joined" to another component, the one component may be directly connected or joined to the other component, but it should be understood that other components may be present therebetween. On the other hand, when the one component is referred to as being "directly connected to" or "directly in contact with" the other component, it should be understood that other components are not present therebetween. Other expressions for the description of a relationship between components, that is, "between" and "directly between" or "adjacent to" and "directly adjacent to", should be interpreted in the same manner.

The terms used in the specification are only used to describe specific embodiments, and are not intended to limit the present disclosure. In this specification, an expression in a singular form also includes the plural form, unless otherwise clearly specified in context. It should be understood that expressions such as "comprise" and "have" in this specification are intended to designate the presence of embodied features, numbers, steps, operations, components, parts, or combinations thereof, but do not exclude the presence or addition of one or more other features, numbers, steps, operations, components, parts, or combinations thereof.

Unless otherwise defined, all terms used herein, including technical and scientific terms, have the same meanings as those commonly understood by those skilled in the art to which the present disclosure pertains. Terms such as those defined in commonly used dictionaries should be interpreted as having meanings consistent with their meanings in the context of the related technology. Further, unless explicitly defined in this specification, the above-mentioned terms should not be interpreted in an ideal or overly formal sense.

Hereinafter, the present disclosure will be described in detail by describing various embodiments with reference to the accompanying drawings. The same reference numerals in each drawing represent the same members.

Figure 2:
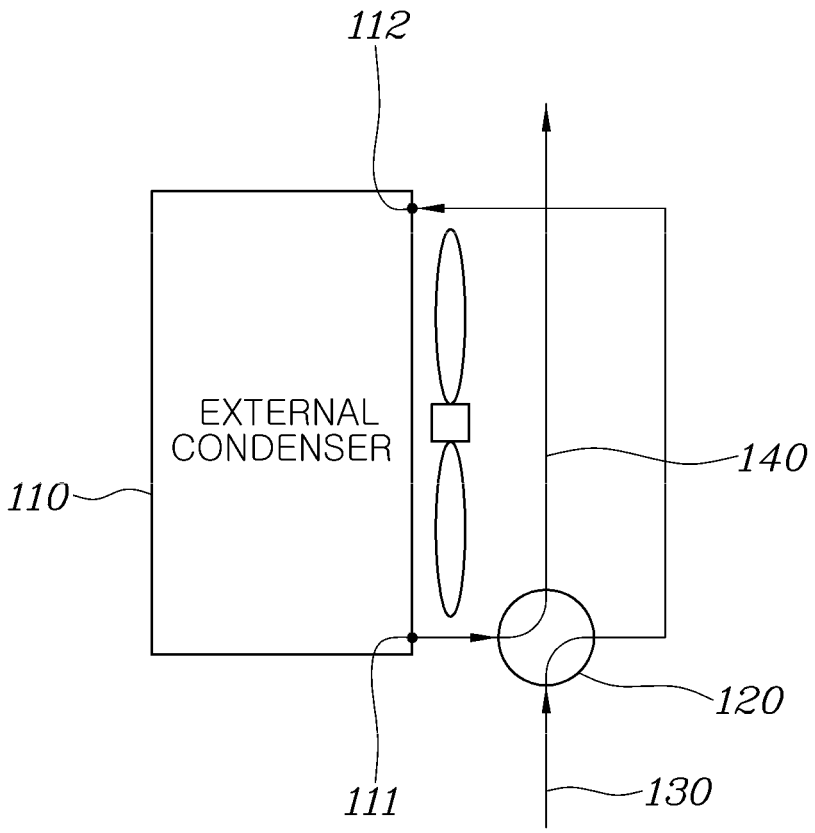
FIG. 2 shows a block diagram of a condenser module in a second operation mode according to an embodiment of the present disclosure.
Figure 3:
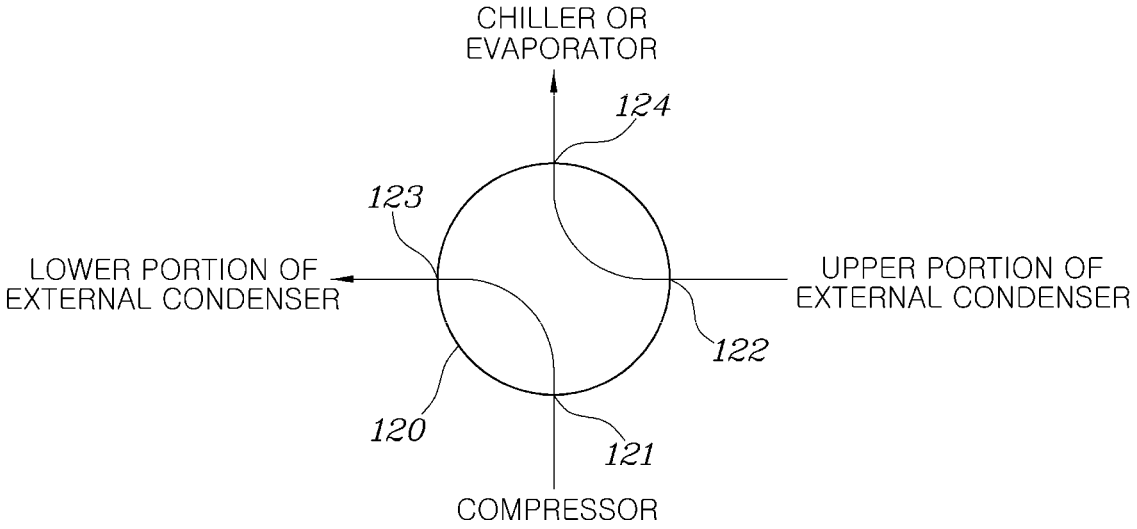
FIG. 3 shows the state of a flow-path switching valve in the first operation mode according to the embodiment of the present disclosure.
Figure 4:
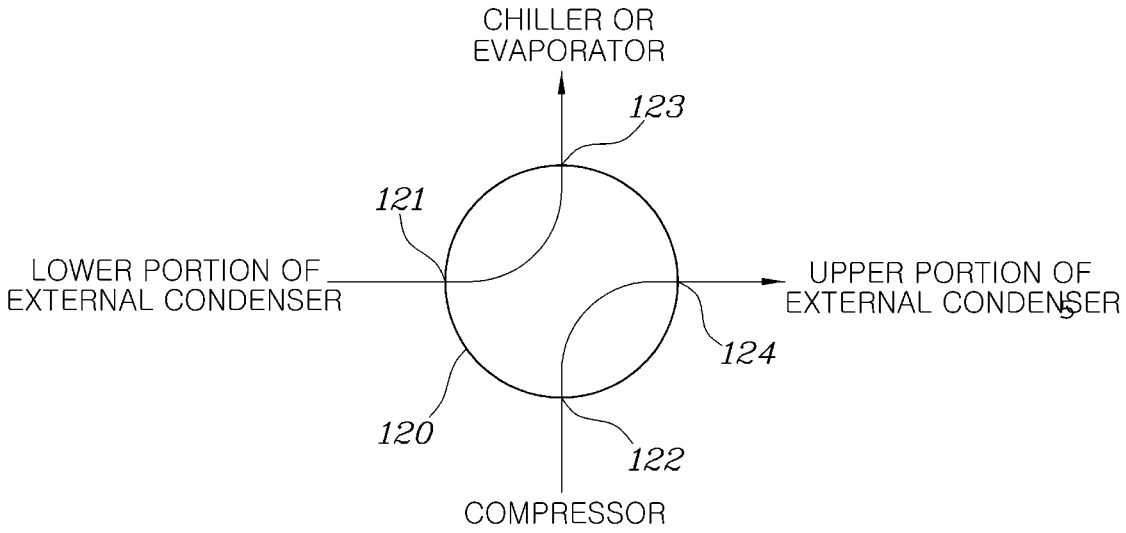
FIG. 4 shows the state of a flow-path switching valve in the second operation mode according to the embodiment of the present disclosure.

FIGS. 1 and 2 show block diagrams of a condenser module 100 in a first operation mode and a second operation mode according to an embodiment of the present disclosure, and FIGS. 3 and 4 show the state of a flow-path switching valve 120 in the first operation mode and the second operation mode according to the embodiment of the present disclosure.

Referring to FIGS. 1 to 4, the condenser module 100 according to the embodiment of the present disclosure includes a heat exchange device 110 including a first inlet/outlet 111 and a second inlet/outlet 112 having a refrigerant flowing thereinto or discharged therefrom, the heat exchange device 110 including a flow path formed therein through which the refrigerant flows between the first inlet/outlet 111 and the second inlet/outlet 112; a flow-path switching valve 120 connected to each of the first inlet/outlet 111 and the second inlet/outlet 112, the flow-path switching valve 120 switchable between a first operation mode in which the refrigerant flows into the first inlet/outlet 111 and the refrigerant is discharged from the second inlet/outlet 112, and a second operation mode in which the refrigerant flows into the second inlet/outlet 112 and the refrigerant is discharged from the first inlet/outlet 111. Here, the flow path formed in the heat exchange device 110 may have different positions in a direction of gravity between the first inlet/outlet 111 and the second inlet/outlet 112.

The heat exchange device 110 may be an external condenser disposed outside to exchange heat with outside air. The heat exchange device 110 may have a structure in which a surface area is increased in order to improve heat exchange performance with the outside air.

In addition, the flow path is formed in the heat exchange device 110, and the flow path inside the heat exchange device 110 may extend between and connect the first inlet/outlet 111 and the second inlet/outlet 112. Particularly, the flow path, extending in the heat exchange device 110 between the first inlet/outlet 111 and the second inlet/outlet 112, may vary in position in the direction of gravity, that is, in a vertical direction.

In the embodiment, the second inlet/outlet 112 is located relatively below the first inlet/outlet 111 in the direction of gravity, or the flow path, extending from the first inlet/outlet 111 to the second inlet/outlet 112, may be bent upwards or downwards in the direction of gravity inside the heat exchange device 110.

The flow-path switching valve 120 is connected to each of the first inlet/outlet 111 and the second inlet/outlet 112 of the heat exchange device 110, thereby allowing the refrigerant to flow into the heat exchange device 110 or discharging the refrigerant outside the heat exchange device 110.

Particularly, the flow-path switching valve 120 is switchable between the first operation mode, in which the refrigerant flows into the first inlet/outlet 111 and the refrigerant is discharged from the second inlet/outlet 112, and the second operation mode, in which the refrigerant flows into the second inlet/outlet 112 and the refrigerant is discharged from the first inlet/outlet 111.

Figure 5:
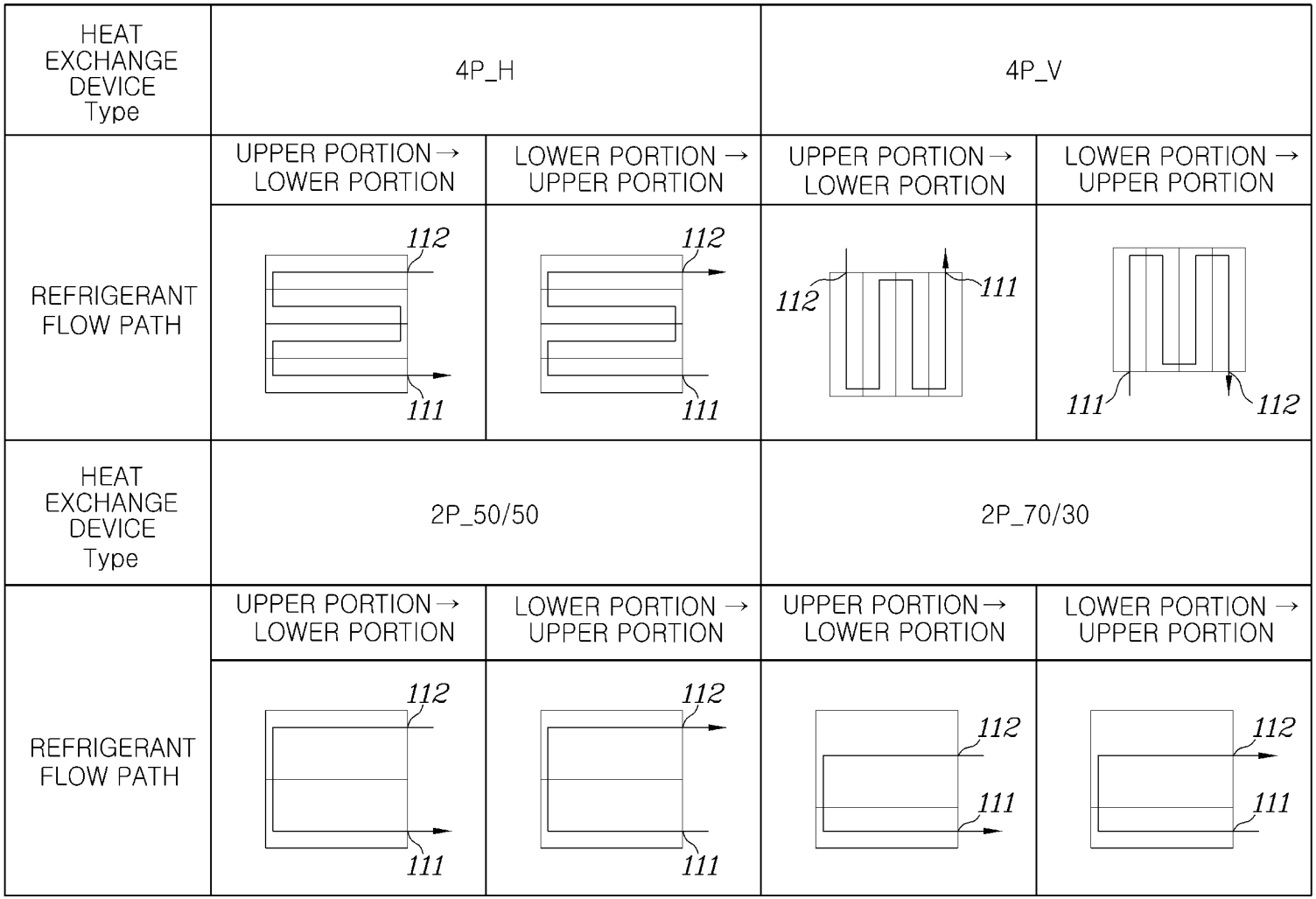
FIG. 5 shows a type of heat exchange device according to various embodiments of the present disclosure.

FIG. 5 shows a type of the heat exchange device 110 according to various embodiments of the present disclosure.

Referring further to FIG. 5, the heat exchange device 110 applied to the external condenser module 100 may be any of various types. A refrigerant flow path, which extends from an inlet of the heat exchange device 110 to an outlet thereof, may be formed in the heat exchange device 110. Specifically, the refrigerant flow path may extend from an inlet located at an upper portion to an outlet located at a lower portion (upper portion→lower portion), thereby extending downwards in the direction of gravity. Alternatively, the refrigerant flow path may extend from an inlet located at the lower portion to an outlet located at the upper portion (lower portion→upper portion), thereby extending upwards in the direction of gravity.

Here, the refrigerant flow path, extending upwards or downwards in the direction of gravity, indicates the cases shown in embodiments (4P_H, 2P_50/50, and 2P_70/30) in which the inlet and the outlet are relatively spaced apart from each other in the vertical direction, and further indicates the cases in which, even though the inlet and outlet are disposed at the same position in the vertical direction (4P_V), the refrigerant flow path extends downwards in the direction of gravity (upper portion→lower portion) when the refrigerant flows downwards at the inlet and flows upwards at the outlet, or the refrigerant flow path extends upwards in the direction of gravity (lower portion→upper portion) when the refrigerant flows upwards at the inlet and flows downwards at the outlet.

In the embodiment, a flow path entering at the first inlet/outlet 111 of the heat exchange device 110 and exiting at the second inlet/outlet 112 thereof may extend upwards in the direction of gravity, and a flow path entering at the second inlet/outlet 112 thereof and exiting at the first inlet/outlet 111 thereof may extend downwards in the direction of gravity.

That is, in the first operation mode, in which the refrigerant flows into the first inlet/outlet 111 and the refrigerant is discharged from the second inlet/outlet 112, the flow path, through which the refrigerant flows in the heat exchange device 110, may extend upwards in the direction of gravity. Further, in the second operation mode, in which the refrigerant flows into the second inlet/outlet 112 and the refrigerant is discharged from the first inlet/outlet 111, the flow path, through which the refrigerant flows in the heat exchange device 110, may extend downwards in the direction of gravity.

In addition, the flow-path switching valve 120 may be connected to each of an inlet line 130 and an outlet line 140. In the first operation mode, the flow-path switching valve 120 may connect the inlet line 130 to the first inlet/outlet 111 and connect the outlet line 140 to the second inlet/outlet 112. In the second operation mode, the flow-path switching valve 120 may connect the inlet line 130 to the second inlet/outlet 112 and connect the outlet line 140 to the first inlet/outlet 111.

Specifically, the flow-path switching valve 120 may be connected to each of the inlet line 130 and the outlet line 140. In the first operation mode, since the first inlet/outlet 111 is the inlet of the heat exchange device 110, the inlet line 130 may be connected to the first inlet/outlet 111. Further, since the second inlet/outlet 112 is the outlet of the heat exchange device 110, the outlet line 140 may be connected to the second inlet/outlet 112.

Conversely, in the second operation mode of the flow-path switching valve 120, since the second inlet/outlet 112 is the inlet of the heat exchange device 110, the inlet line 130 may be connected to the second inlet/outlet 112. Further, since the first inlet/outlet 111 is the outlet of the heat exchange device 110, the outlet line 140 may be connected to the first inlet/outlet 111.

The flow-path switching valve 120 may be a 4-way valve having two inlets 121 and 122 and two outlets 123 and 124 so that the inlet line 130 is connected to one of the first inlet/outlet 111 and the second inlet/outlet 112, and the outlet line 140 is connected to the other one of the first inlet/outlet 111 and the second inlet/outlet 112.

Particularly, the flow-path switching valve 120 may have two flow paths, each of which is connected to a corresponding one of the inlets 121 and 122 and a corresponding one of the outlets 123 and 124, and, as such, the respective flow paths may be formed in the state of being separated from each other.

As will be described later, the refrigerant discharged from a compressor 200 may flow into one of the inlets 121 and 122, and the refrigerant may be discharged to the first inlet/outlet 111 of the heat exchange device 110 or the second inlet/outlet 112 thereof through one of the outlets 123 and 234. In addition, the refrigerant discharged from the first inlet/outlet 111 or the second inlet/outlet 112 of the heat exchange device 110 flows into the other one of the inlets 121 and 122, and the refrigerant may be discharged to an evaporator 300 or a chiller 500 through the other one of the outlets 123 and 124.

Figure 6:
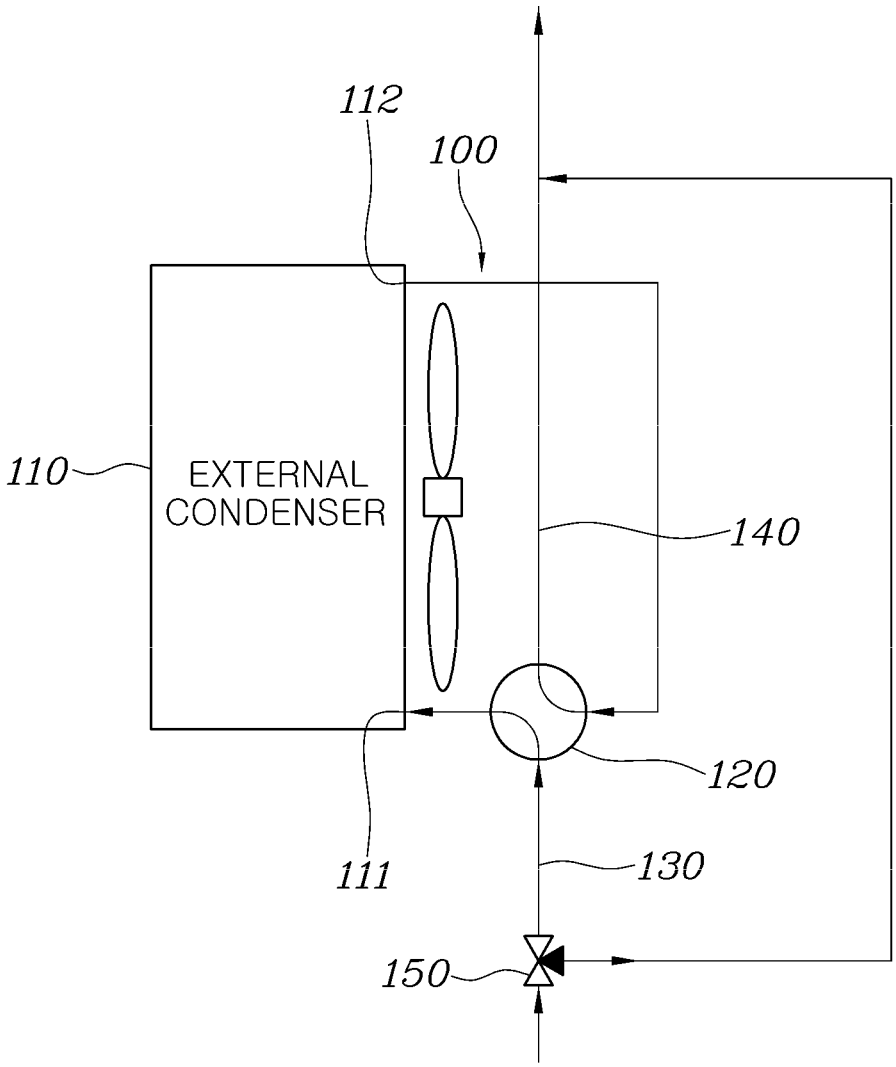
FIG. 6 shows a block diagram of a condenser module in a first operation mode according to another embodiment of the present disclosure.

FIG. 6 shows a block diagram of the condenser module 100 in the first operation mode according to another embodiment of the present disclosure.

Referring further to FIG. 6, the condenser module 100 may further include a bypass valve 150 disposed at a point upstream of the flow-path switching valve 120 in the flow direction of the refrigerant and configured to cause the refrigerant flowing thereinto to flow to the flow-path switching valve 120 or to be switched to cause the refrigerant flowing thereinto to bypass the flow-path switching valve 120 and the heat exchange device 110.

In the embodiment, the bypass valve 150 may be a 3-way valve, and may cause the refrigerant flowing thereinto through the inlet line 130 to flow to the inlet of the flow-path switching valve 120, or may switch the flow path so that the refrigerant bypasses the flow-path switching valve 120 and the heat exchange device 110 to join an outlet line 140.

Figure 7:
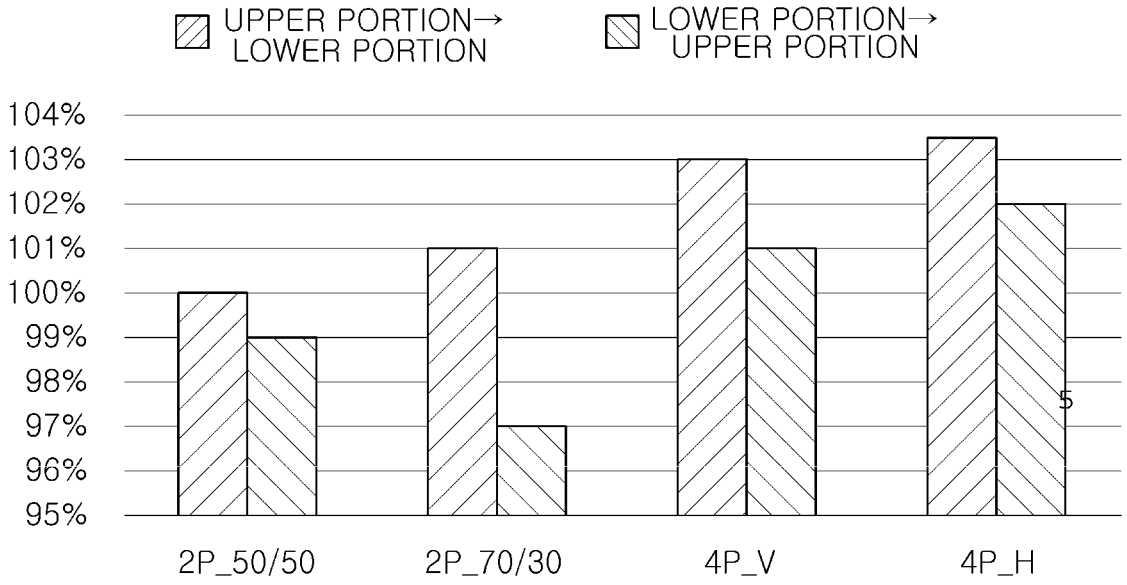
FIG. 7 shows cooling efficiency depending on the internal flow direction of an external condenser during indoor cooling.
Figure 8:
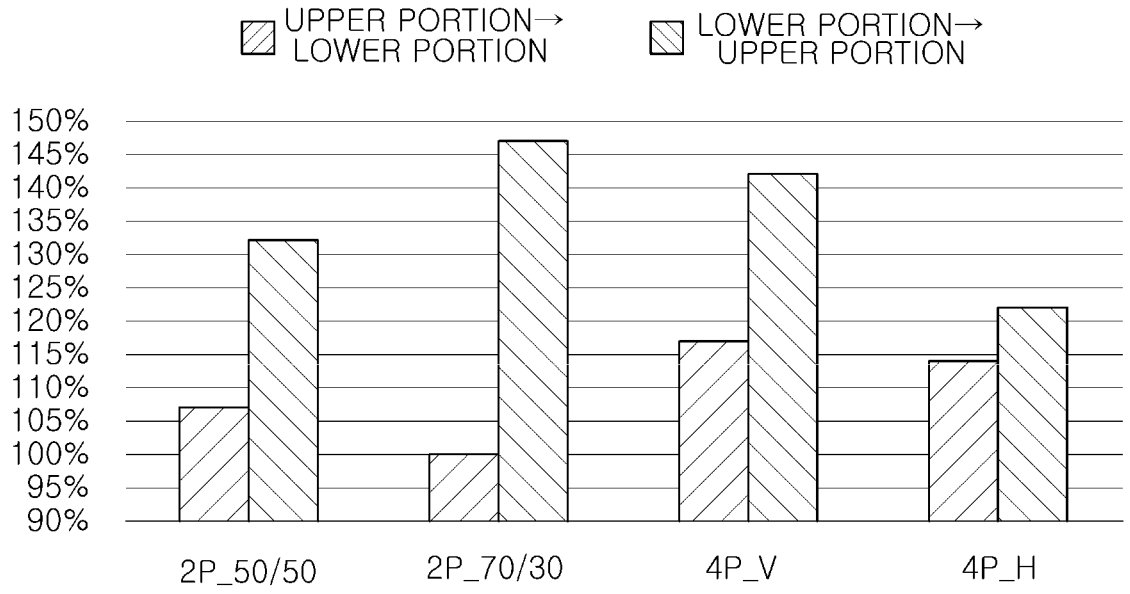
FIG. 8 shows heating efficiency depending on the internal flow direction of an external condenser during indoor heating.

FIGS. 7 and 8 show cooling efficiency and heating efficiency depending on the internal flow direction of the external condenser during indoor cooling and indoor heating, respectively.

Referring further to FIGS. 7 and 8, during indoor cooling, an experimental example (upper portion→lower portion), in which the flow path of the refrigerant extends downwards in the direction of gravity in the external condenser (serving as a radiator), shows a somewhat more desirable result than an experimental example (lower portion→upper portion), in which the flow path of the refrigerant extends upwards in the direction of gravity therein.

Further, during indoor heating, an experimental example (lower portion→upper portion), in which the flow path of the refrigerant extends upwards in the direction of gravity in the external condenser (serving as the evaporator 300), shows a significantly more desirable result than an experimental example (upper portion→lower portion), in which the flow path of the refrigerant extends downwards in the direction of gravity therein.

Accordingly, the flow path of the refrigerant flowing into the external condenser is switched during indoor cooling and indoor heating, thereby having an effect of securing both cooling efficiency and heating efficiency.

Figure 9:
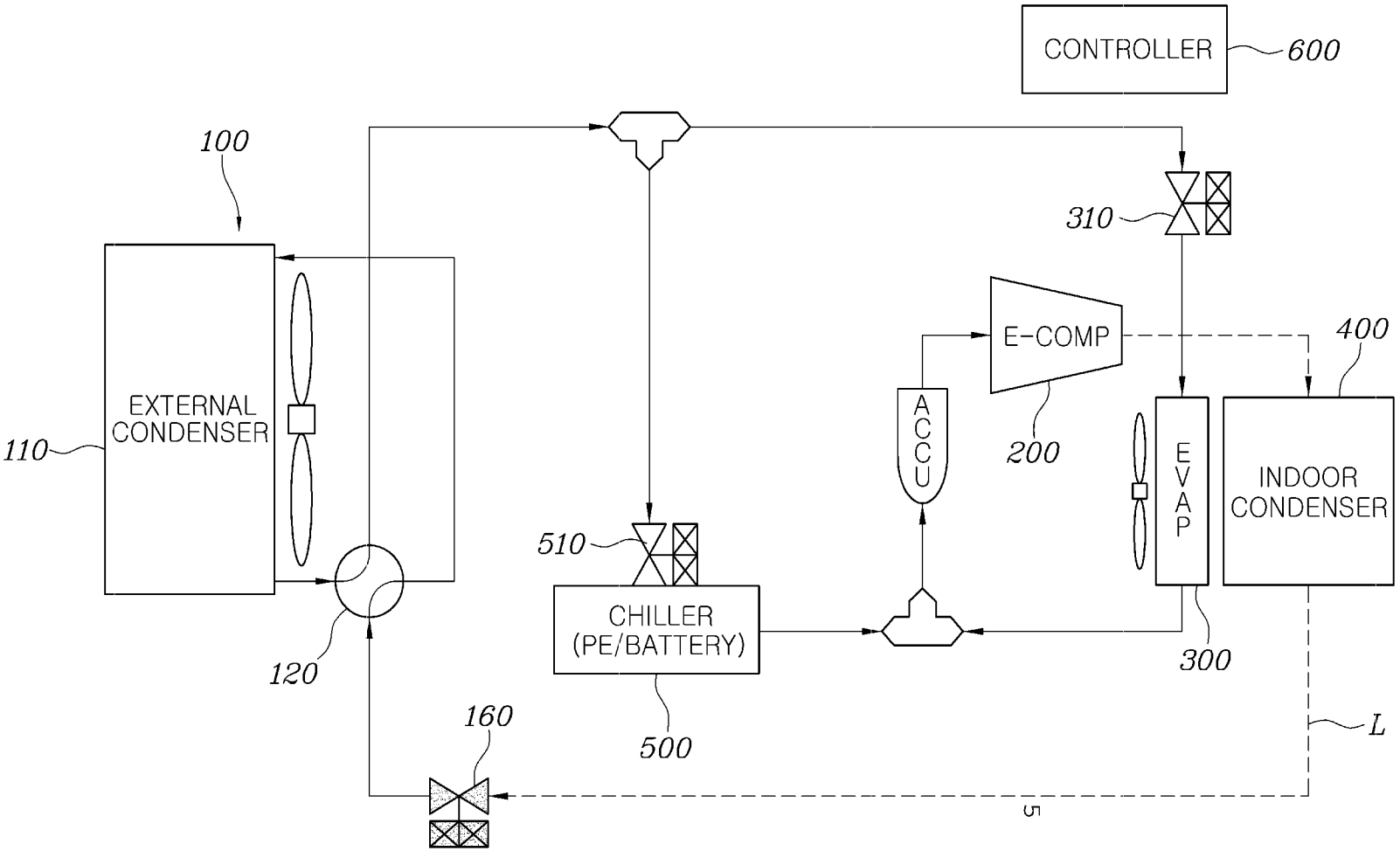
FIG. 9 shows a block diagrams of a thermal management system including the condenser module in the first operation mode according to the embodiment of the present disclosure.
Figure 10:
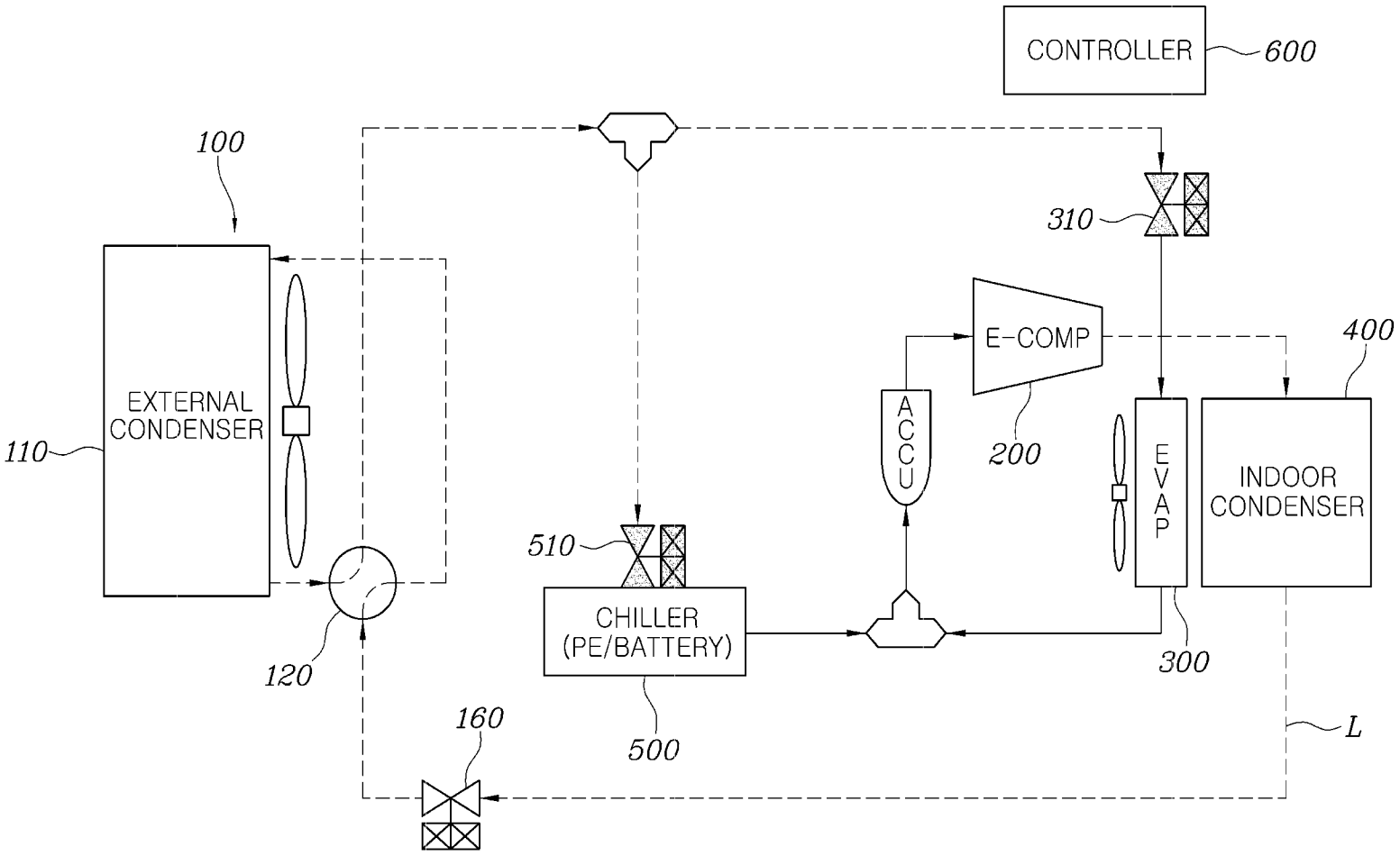
FIG. 10 shows a block diagrams of a thermal management system including the condenser module in the second operation mode according to the embodiment of the present disclosure.

FIGS. 9 and 10 show block diagrams of a thermal management system including the condenser module 100 in the first operation mode and the second operation mode according to the embodiment of the present disclosure.

Referring further to FIGS. 9 and 10, the thermal management system including the condenser module 100 according to the embodiment of the present disclosure includes the compressor 200, located at a point upstream of the condenser module 100 in the flow direction of the refrigerant and configured to compress and discharge the refrigerant flowing thereinto at high temperature and high pressure; the evaporator 300, located at a point downstream of the condenser module 100 in the flow direction of the refrigerant and configured to evaporate the flowing refrigerant; a first expansion valve 160, located at a point upstream of the condenser module 100 in the flow direction of the refrigerant and configured to permit flow of, block, or expand the refrigerant flowing into the condenser module 100; a second expansion valve 310, located at a point upstream of the evaporator 300 in the flow direction of the refrigerant and configured to permit flow of, block, or expand the refrigerant flowing into the evaporator 300; and a refrigerant circulation flow path L extending so that the refrigerant flowing thereinto circulates while sequentially passing through the compressor 200, the first expansion valve 160, the condenser module 100, the second expansion valve 310, and the evaporator 300.

The refrigerant circulation flow path L may be a refrigerant flow path of a heat pump cycle through the refrigerant flows. The compressor 200, the first expansion valve 160, the condenser module 100, the second expansion valve 310, and the evaporator 300 are sequentially provided in the refrigerant circulation flow path L. Further, the refrigerant circulation flow path L may extend so that the refrigerant flowing thereinto circulates while sequentially passing through the compressor 200, the first expansion valve 160, the condenser module 100, the second expansion valve 310, and the evaporator 300.

The compressor 200 is provided in the refrigerant circulation flow path L at a point upstream of the condenser module 100, and may compress and discharge the refrigerant flowing thereinto during operation at high temperature and high pressure.

The evaporator 300 is provided in the refrigerant circulation flow path L at a point downstream of the condenser module 100, and may absorb ambient heat while evaporating the flowing refrigerant. Particularly, the evaporator 300 may be provided in an indoor air-conditioning line to cool the indoor air.

The first expansion valve 160 is provided in the refrigerant circulation flow path L at a point upstream of the condenser module 100. Further, the first expansion valve 160 may be completely opened to allow the refrigerant to flow, may be closed to block the refrigerant, or may expand the refrigerant. Particularly, when the condenser module 100 is used for the purpose of evaporating the refrigerant in the indoor heating mode, the first expansion valve 160 may expand the refrigerant at the point upstream of the condenser module 100.

The second expansion valve 310 is provided in the refrigerant circulation flow path L at a point upstream of the evaporator 300. Further, the second expansion valve 310 may be completely opened to allow the refrigerant to flow, may be closed to block the refrigerant, or may expand the refrigerant. Particularly, when the evaporator 300 is used for the purpose of evaporating the refrigerant in the indoor cooling mode, the second expansion valve 310 may expand the refrigerant at the point upstream of the evaporator 300.

The thermal management system may further include an indoor condenser 400, located between the compressor 200 and the condenser module 100 in the flow direction of the refrigerant and configured to disperse the refrigerant discharged from the compressor 200 therearound.

The indoor condenser 400 is provided in the refrigerant circulation flow path L between the compressor 200 and the condenser module 100, and may disperse high-temperature/high-pressure refrigerant discharged from the compressor 200 therearound. Particularly, the indoor condenser 400 may be provided in the indoor air-conditioning line to heat the indoor air.

The thermal management system may further include a controller 600, configured to control, in the indoor heating mode, the first expansion valve 160 to expand the refrigerant flowing thereinto and to control the flow-path switching valve 120 so that the refrigerant expanded in the first expansion valve 160 flows into the first inlet/outlet 111 of the heat exchange device 110 and is discharged from the second inlet/outlet 112 thereof. Here, the flow path entering at the first inlet/outlet 111 of the heat exchange device 110 and exiting at the second inlet/outlet 112 thereof may extend upwards in the direction of gravity.

The controller 600 according to the embodiment of the present disclosure may be implemented by an algorithm configured to control the operation of various components of a vehicle, a non-volatile memory (not shown) configured to store data related to software instructions that execute the algorithm, or a processor (not shown) configured to perform operations described below using the data stored in the memory. Here, the memory and the processor may be implemented as separate chips.

Alternatively, the memory and the processor may be implemented as a single chip in which the memory and the processor are integrated with each other. The processor may take the form of one or more processors.

The controller 600 may control the flow-path switching valve 120 in the first operation mode, as shown in FIG. 9, in the indoor heating mode. The controller 600 may control the flow-path switching valve 120 in the first operation mode so that the refrigerant expanded in the first expansion valve 160 flows into the first inlet/outlet 111 of the heat exchange device 110 through the flow-path switching valve 120, and the refrigerant discharged from the second inlet/outlet 112 of the heat exchange device 110 is discharged to the flow-path switching valve 120.

The thermal management system may further include a chiller 500, branching from a point downstream of the condenser module 100 in the flow direction of the refrigerant, located to be connected to the compressor 200 in parallel with the evaporator 300, and configured to heat-exchange the refrigerant discharged from the condenser module 100 with a coolant, and a third expansion valve 510, located at a point upstream of the chiller 500 in the flow direction of the refrigerant and configured to permit flow of, block, or expand the refrigerant flowing into the chiller 500.

The chiller 500 is provided in a refrigerant circulation line branching from the point downstream of the condenser module 100 and joining the point upstream of the compressor 200 while bypassing the evaporator 300. Accordingly, the chiller 500 may be connected to the compressor 200 in parallel with the evaporator 300.

The chiller 500 may be a device disposed so as to heat-exchange the refrigerant flowing thereinto with the coolant that cools a battery or an electronic component.

The third expansion valve 510 is provided in the refrigerant circulation flow path L at the point upstream of the chiller 500. Further, the third expansion valve 510 may be completely opened to allow the refrigerant to flow, may be closed to block the refrigerant, or may expand the refrigerant. Particularly, when the chiller 500 is used for the purpose of evaporating the refrigerant in an endothermic mode, in which heat is absorbed by a coolant that cools the electric components or the battery, the third expansion valve 510 may expand the refrigerant at the point upstream of the chiller 500.

The thermal management system may further include the controller 600, configured to control, in the indoor cooling mode, the flow-path switching valve 120 so that the refrigerant flowing into the flow-path switching valve 120 flows into the second inlet/outlet 112 of the heat exchange device 110 and is discharged from the first inlet/outlet 111 and to control the second expansion valve 310 or the third expansion valve 510 to expand the refrigerant flowing thereinto. The flow path entering at the second inlet/outlet 112 of the heat exchange device 110 and exiting at the first inlet/outlet 111 thereof may extend downwards in the direction of gravity.

The controller 600 may control, in the indoor cooling mode, the flow-path switching valve 120 in the second operation mode as shown in FIG. 10. The controller 600 may control the flow-path switching valve 120 in the second operation mode so that the refrigerant flowing into the flow-path switching valve 120 flows into the second inlet/outlet 112 of the heat exchange device 110 and the refrigerant discharged from the first inlet/outlet 111 of the heat exchange device 110 is discharged to the flow-path switching valve 120.

Figure 11:
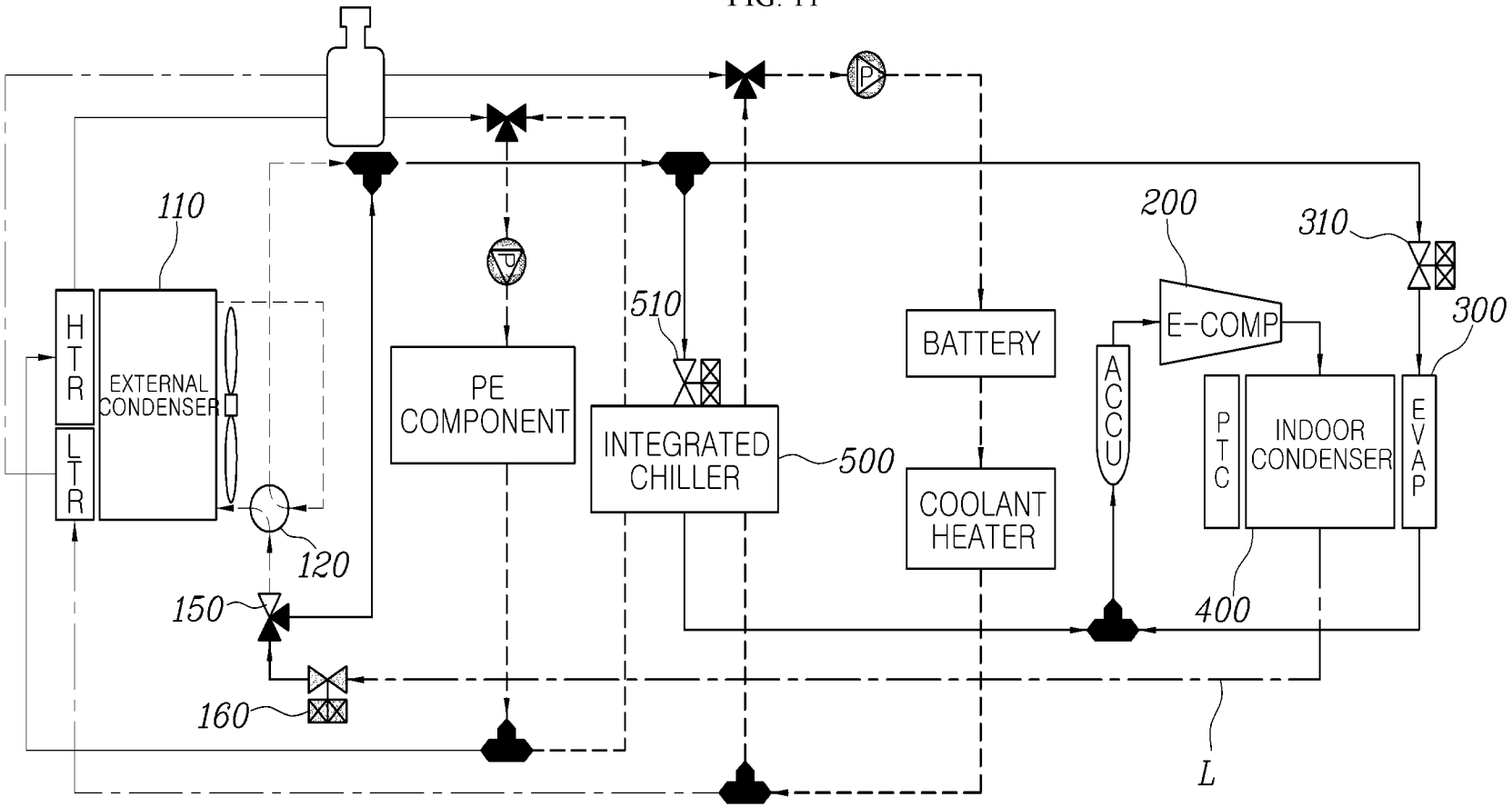
FIG. 11 shows a block diagram of a thermal management system including the condenser module according to another embodiment of the present disclosure.

FIG. 11 shows a block diagram of a thermal management system including the condenser module 100 according to another embodiment of the present disclosure.

Referring further to FIG. 11, the thermal management system may further include a bypass valve 150, disposed at a point upstream of the flow-path switching valve 120 in the flow direction of the refrigerant and configured to cause the refrigerant flowing thereinto to flow to the flow-path switching valve 120 or to be switched to cause the refrigerant flowing thereinto to flow to the evaporator 300 by bypassing the flow-path switching valve 120 and the heat exchange device 110.

The bypass valve 150 is provided in the refrigerant circulation line at the point upstream of the flow-path switching valve 120, and may be a 3-way valve. The controller 600 selectively causes the refrigerant flowing into the bypass valve 150 to flow to the heat exchange device 110 of the condenser module 100 through the flow-path switching valve 120 or to directly flow to the chiller 500 or the evaporator 300 by bypassing the flow-path switching valve 120 and the heat exchange device 110.

In another embodiment, it is possible to apply an integrated valve capable of simultaneously implementing the function of the 4-way valve of the flow-path switching valve 120 and the function of the 3-way valve of the bypass valve 150 by integrating the flow-path switching valve 120 and the bypass valve 150.

As is apparent from the above description, the present disclosure provides a condenser module and a thermal management system including the same capable of simultaneously securing cooling efficiency and heating efficiency by switching a flow path of a refrigerant flowing into an external condenser during indoor cooling and indoor heating.

Although the embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. A condenser module comprising:

a heat exchange device comprising a first inlet/outlet and a second inlet/outlet having a refrigerant flowing thereinto or discharged therefrom, the heat exchange device comprising a flow path formed therein through which the refrigerant flows between the first inlet/outlet and the second inlet/outlet; and a flow-path switching valve connected to each of the first inlet/outlet and the second inlet/outlet, the flow-path switching valve switchable between a first operation mode, in which the refrigerant flows into the first inlet/outlet and the refrigerant is discharged from the second inlet/outlet, and a second operation mode, in which the refrigerant flows into the second inlet/outlet and the refrigerant is discharged from the first inlet/outlet, wherein the flow path formed in the heat exchange device has different positions in a direction of gravity between the first inlet/outlet and the second inlet/outlet, and wherein the flow-path switching valve is connected to each of an inlet line and an outlet line, the flow-path switching valve connecting the inlet line to the first inlet/outlet and connecting the outlet line to the second inlet/outlet in the first operation mode, and connecting the inlet line to the second inlet/outlet and connecting the outlet line to the first inlet/outlet in the second operation mode.

2. The condenser module according to claim 1, wherein the flow path entering at the first inlet/outlet of the heat exchange device and exiting at the second inlet/outlet thereof extends upwards in the direction of gravity, and the flow path entering at the second inlet/outlet thereof and exiting at the first inlet/outlet thereof extends downwards in the direction of gravity.

3. The condenser module according to claim 1, wherein the flow-path switching valve is a 4-way valve comprising two inlets and two outlets so that the inlet line is connected to one of the first inlet/outlet and the second inlet/outlet, and the outlet line is connected to the other one of the first inlet/outlet and the second inlet/outlet.

4. The condenser module according to claim 1, further comprising a bypass valve disposed at a point upstream of the flow-path switching valve in a flow direction of the refrigerant and configured to cause the refrigerant flowing thereinto to flow to the flow-path switching valve or to be switched to cause the refrigerant flowing thereinto to bypass the flow-path switching valve and the heat exchange device.

5. A thermal management system comprising the condenser module according to claim 1, the thermal management system comprising:

a compressor located at a point upstream of the condenser module in a flow direction of the refrigerant and configured to compress and discharge the refrigerant flowing thereinto at high temperature and high pressure;

an evaporator located at a point downstream of the condenser module in the flow direction of the refrigerant and configured to evaporate the flowing refrigerant;

a first expansion valve located at a point upstream of the condenser module in the flow direction of the refrigerant and configured to permit flow of, block, or expand the refrigerant flowing into the condenser module;

a second expansion valve located at a point upstream of the evaporator in the flow direction of the refrigerant and configured to permit flow of, block, or expand the refrigerant flowing into the evaporator; and a refrigerant circulation flow path extending so that the refrigerant flowing thereinto circulates while sequentially passing through the compressor, the first expansion valve, the condenser module, the second expansion valve, and the evaporator.

6. The thermal management system according to claim 5, further comprising an indoor condenser located between the compressor and the condenser module in the flow direction of the refrigerant and configured to disperse the refrigerant discharged from the compressor therearound.

7. The thermal management system according to claim 6, further comprising a controller configured to control, in an indoor heating mode, the first expansion valve to expand the refrigerant flowing thereinto and to control the flow-path switching valve so that the refrigerant expanded in the first expansion valve flows into the first inlet/outlet of the heat exchange device and is discharged from the second inlet/outlet thereof, wherein the flow path entering at the first inlet/outlet of the heat exchange device and exiting at the second inlet/outlet thereof extends upwards in the direction of gravity.

8. The thermal management system according to claim 5, further comprising:

a chiller configured to branch from a point downstream of the condenser module in the flow direction of the refrigerant, located to be connected to the compressor in parallel with the evaporator, and configured to heat-exchange the refrigerant discharged from the condenser module with a coolant; and a third expansion valve located at a point upstream of the chiller in the flow direction of the refrigerant and configured to permit flow of, block, or expand the refrigerant flowing into the chiller.

9. The thermal management system according to claim 8, further comprising a controller configured to control, in an indoor cooling mode, the flow-path switching valve so that the refrigerant flowing into the flow-path switching valve flows into the second inlet/outlet of the heat exchange device and is discharged from the first inlet/outlet thereof, and to control the second expansion valve or the third expansion valve to expand the refrigerant flowing thereinto, wherein the flow path entering at the second inlet/outlet of the heat exchange device and exiting at the first inlet/outlet thereof extends downwards in the direction of gravity.

10. The thermal management system according to claim 5, further comprising a bypass valve disposed at a point upstream of the flow-path switching valve in the flow direction of the refrigerant, and configured to cause the refrigerant flowing thereinto to flow to the flow-path switching valve or to be switched to cause the refrigerant flowing thereinto to flow to the evaporator by bypassing the flow-path switching valve and the heat exchange device.

* * * * *